US007418903B2

(12) United States Patent
Liang et al.

(10) Patent No.: US 7,418,903 B2
(45) Date of Patent: Sep. 2, 2008

(54) PRINTING METHOD FOR WINDOW BLIND SLATS

(75) Inventors: Wen Ying Liang, Changhua Hsien (TW); Sheng Ying Hsu, Changhua Hsien (TW)

(73) Assignee: Ching Feng Home Fashions Co., Ltd., Changhua Hsien (TW)

( * ) Notice: Subject to any disclaimer, the term of this patent is extended or adjusted under 35 U.S.C. 154(b) by 323 days.

(21) Appl. No.: 11/331,133

(22) Filed: Jan. 13, 2006

(65) Prior Publication Data

US 2007/0169642 A1 Jul. 26, 2007

(51) Int. Cl.
*B41L 3/02* (2006.01)

(52) U.S. Cl. ..... 101/486; 101/36

(58) Field of Classification Search ..... 101/35, 101/36, 37, 44, 217, 232, 485, 486, 490, 101/492; 156/230, 238, 250
See application file for complete search history.

(56) References Cited

U.S. PATENT DOCUMENTS

| | | | | |
|---|---|---|---|---|
| 1,971,962 | A * | 8/1934 | Jones | 271/123 |
| 6,668,715 | B1 * | 12/2003 | Biro et al. | 101/32 |
| 2006/0016548 | A1 * | 1/2006 | Chang et al. | 156/230 |

* cited by examiner

*Primary Examiner*—Ren Yan
(74) *Attorney, Agent, or Firm*—Troxell Law Office, PLLC

(57) ABSTRACT

A printing method for window blind slats includes three blind slats situated side by side before three printing rollers that are equidistantly spaced out in a transverse direction with one growth-ring printing area and two fine-texture printing areas alternatively arranged and precisely formed at corresponding lengthwise and widthwise positions of the sequentially aligned printing rollers thereon. Via the printing operation of the alternatively-arranged growth-ring printing areas and the fine-texture printing areas of the three printing rollers, the three blind slats thereof can be synchronically printed with complete wood grain pattern and finished with growth-ring pictures and fine-texture pictures disposed thereon, efficiently providing a speedier printing method for the blind slats and ensuring an accurate control of the quality of each blind slat to achieve a standardized manufacturing thereof.

1 Claim, 4 Drawing Sheets

PRINTING METHOD FOR WINDOW BLIND SLATS

BACKGROUND OF THE INVENTION

The present invention is related to a printing method for window blind slats, comprising three printing rollers that are equidistantly spaced out in a transverse direction with one growth-ring printing area and two fine-texture printing areas alternatively arranged and precisely formed at the corresponding lengthwise and widthwise positions of the sequentially aligned printing rollers thereon so that blind slats can be synchronically printed with complete wood grain pattern of growth-ring pictures and fine-texture pictures on the surfaces thereof, efficiently providing a speedier printing method and ensuring an accurate control of the quality of each blind slat so as to boost the competitive power as well as to achieve a standardized manufacturing thereof.

Please refer to FIG. 1. A convention method of printing wood grain pattern onto window blind slats 10 comprises a printing roller 20 having a growth-ring printing area 21 arranged at the middle section thereon, and two fine-texture printing areas 22 distributed at both lateral sections thereon. The conventional printing method thereof includes steps as follows:

First, three blind slats 10, 10', 10"' are located side by side before the printing roller 20 already coated with coloring material, and then transported to move through the printing roller 20 with growth-ring pictures 11' printed onto the middle blind slat 10' and fine-texture pictures 12, 12" printed onto both lateral blind slats 10, 10" thereon respectively.

Second, the three blind slats 10, 10', 10" with the growth-ring pictures 11' or the fine-texture pictures 12', 12" respectively printed thereon are withdrawn and then relocated in front of the printing roller 20 with switched positions before going through the same aforementioned printing process again. After three rounds of the repeated printing process thereof, the blind slats 10, 10', 10" will be respectively printed with complete wood grain pattern and finished with growth-ring pictures 11, 11', 11" and fine-texture pictures 12, 12', 12" disposed thereon.

There are some disadvantages to such conventional printing method for window blind slats. First, although the printing roller 20 can serve to print the three blind slats 10, 10', 10" simultaneously, the three blind slats 10, 10', 10" must be constantly switched in positions to repeat the same printing process over and over again so as to have complete wood grain pattern printed onto the surfaces thereof, which is rather complicated and time-consuming, and thus makes the printed slats uncompetitive on the market. Second, when the slats 10 are repeatedly withdrawn and then printed in the process thereof, part of the growth-ring pictures 11 or the fine-texture pictures 12 may subject to the phenomena of drying-up or color-binding, which can make the wood grain pattern printed onto the slats 10 dye in different shade or incompletely interrupted as shown in A of FIG. 2. Thus, defective slats can easily come up and the quality of the slats 10 is difficult to control in the conventional printing method thereof.

SUMMARY OF THE PRESENT INVENTION

It is, therefore, the primary purpose of the present invention to provide a printing method for window blind slats, utilizing three printing rollers equidistantly spaced out in a transverse direction with one growth-ring printing area and two fine-texture printing areas alternatively arranged to precisely form at corresponding lengthwise and widthwise positions of the sequentially aligned printing rollers thereon so that blind slats can be synchronically printed with complete wood grain pattern without the repeated and complicated printing process of the above-mentioned prior art, permitting a speedier printing method for the blind slats to achieve a standardized manufacturing and boost the competitive power thereof on the market.

It is, therefore, the second purpose of the present invention to provide a printing method for window blind slats wherein the three printing rollers are evenly and transversely spaced out with one growth-ring printing area and two fine-texture printing areas alternatively arranged and formed at corresponding lengthwise and widthwise positions of the printer rollers thereon so as to avoid the problems of color-binding and grain-interrupting found in the conventional printing method for blind slats, ensuring an accurate control of the quality of each blind slat to achieve the standardized manufacturing thereof.

BRIEF DESCRIPTION OF THE DRAWINGS

FIG. 5 is a diagram showing the present invention made into a vertical-type blind slat in application thereof.

DETAILED DESCRIPTION OF THE PREFERRED EMBODIMENTS

Figure 1:
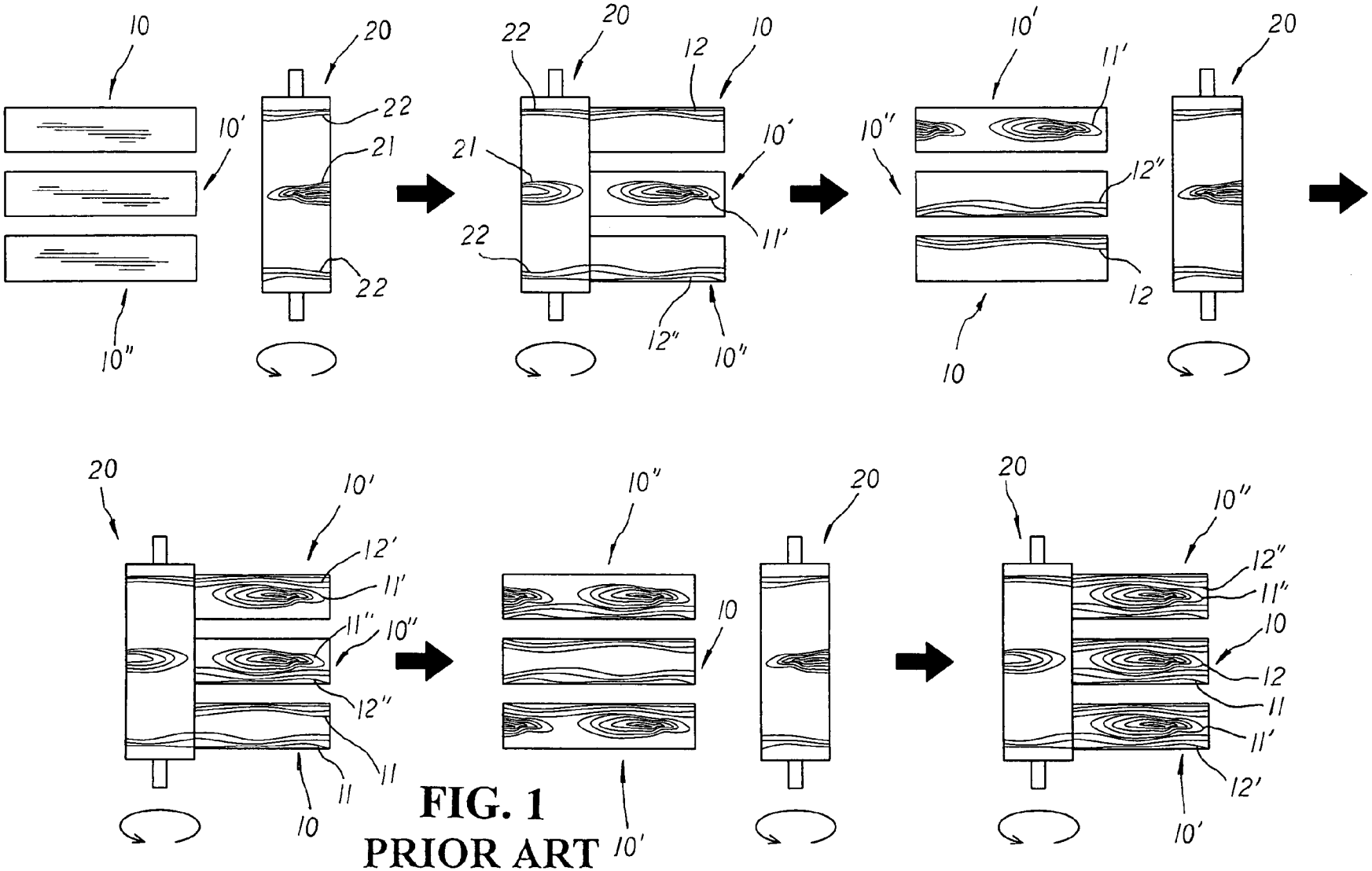
FIG. 1 PRIOR ART
FIG. 1 is a diagram showing a printing flow chart of a conventional printing method for window blind slats.
Figure 2:
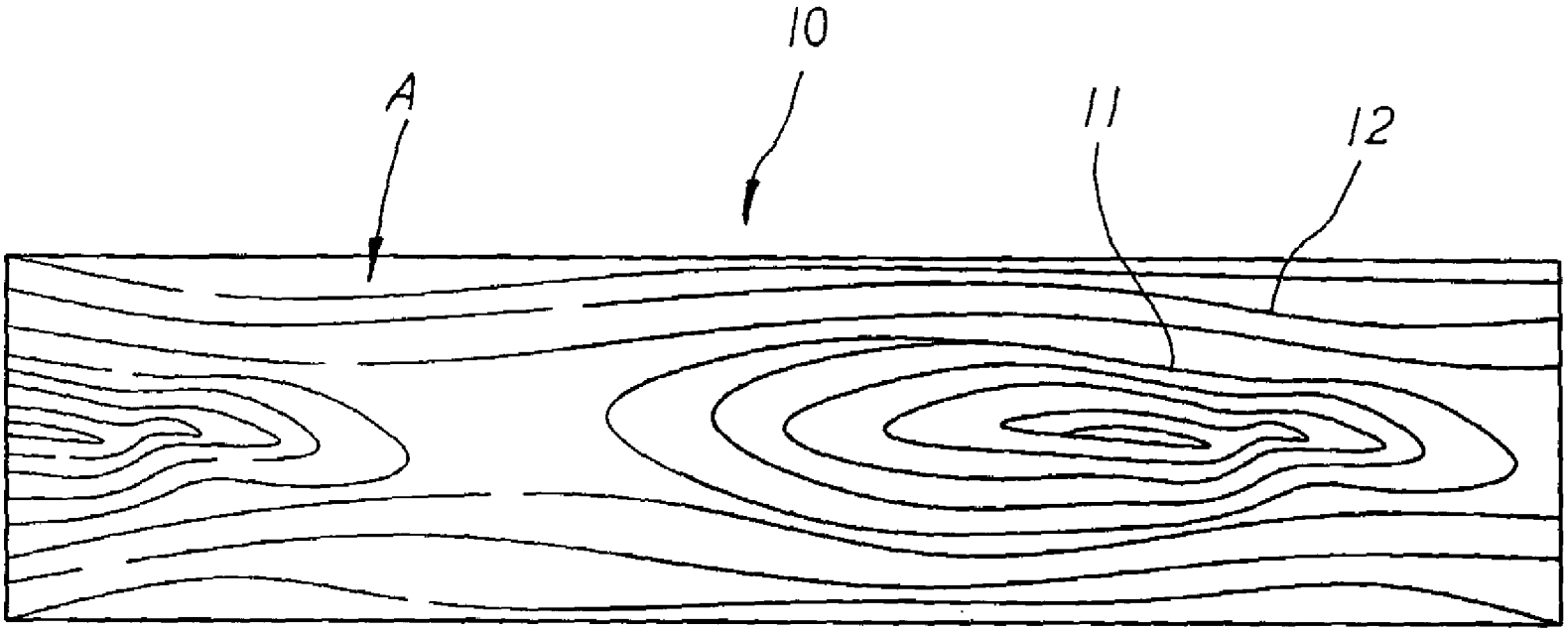
FIG. 2 PRIOR ART
FIG. 2 is a diagram showing the different shade and grain-interruption of a blind slat manufactured in the conventional printing method thereof.
Figure 3:
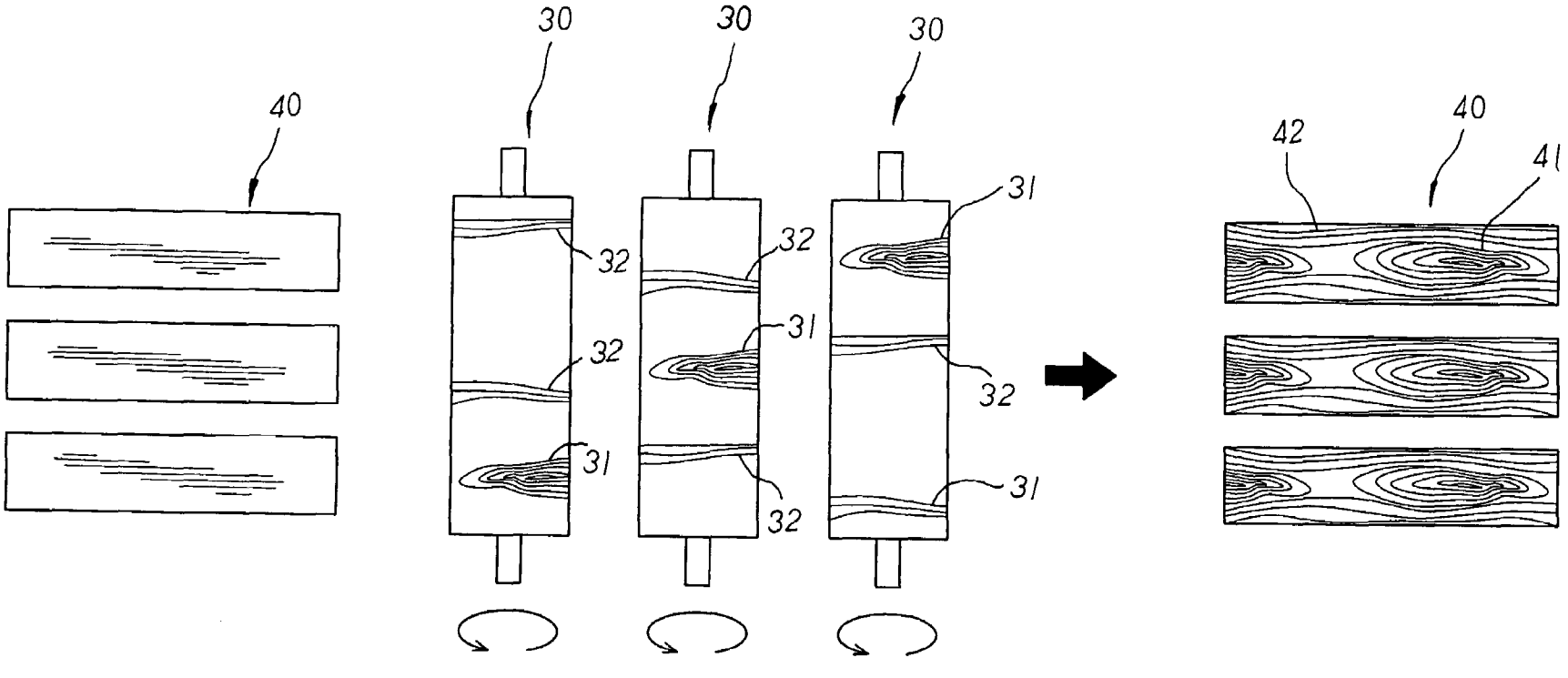
FIG. 3 is a diagram showing a printing flow chart of the present invention.
Figure 4:
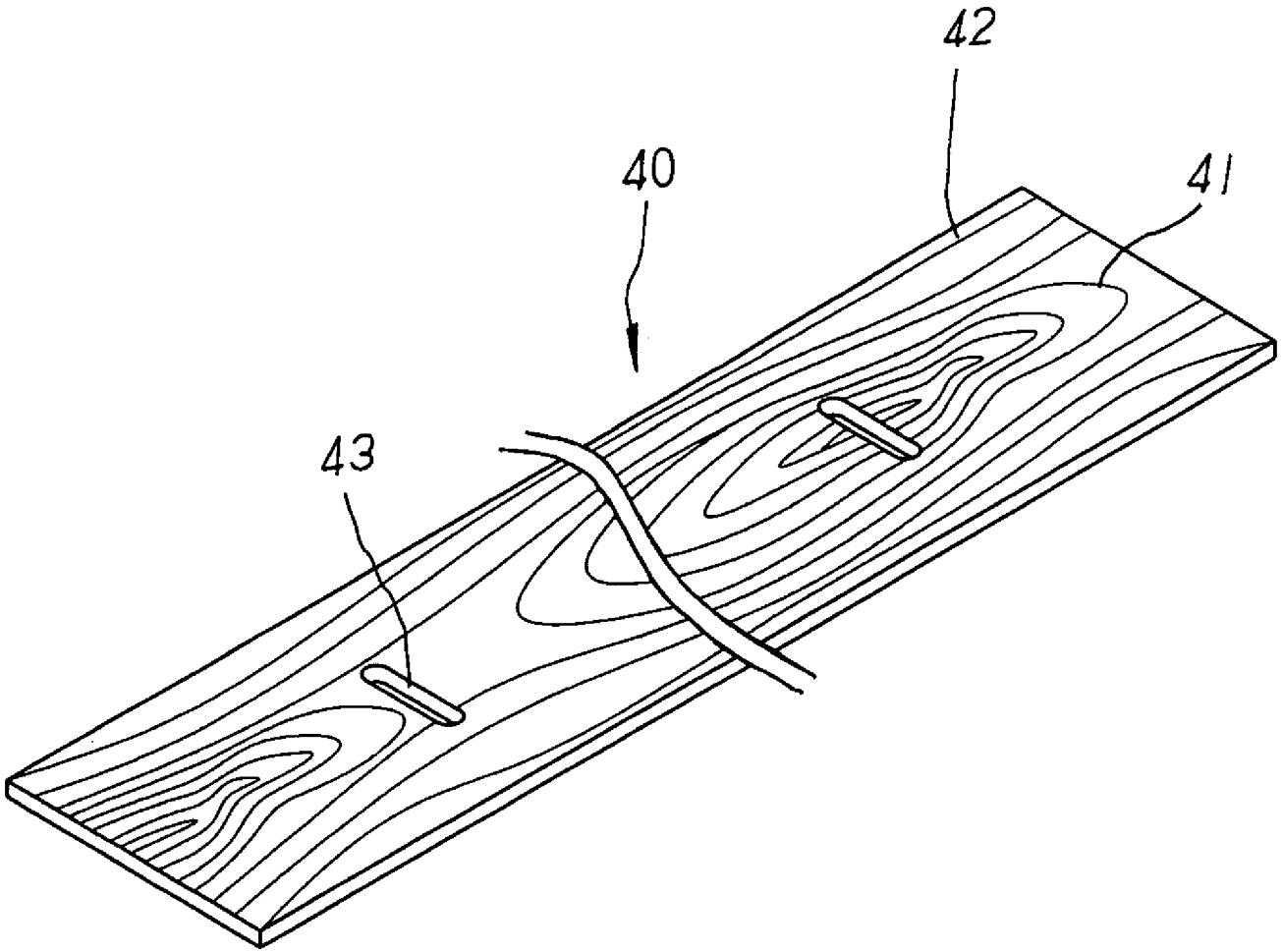
FIG. 4 is a diagram showing a finished slat with complete wood grain pattern printed thereon and made into a horizontal-type blind slat in application.

Please refer to FIG. 3 showing a printing flow chart of the present invention. The present invention is related to a printing method for window blind slats, comprising three printing rollers 30 wherein each printing roller 30 is equipped with one growth-ring printing area 31 and two fine-texture printing areas 32 arranged at the circumferential surface thereon, and the growth-ring printing area 31 and the fine-texture printing areas 32 thereof are made in wood grain pattern. The three printing rollers 30 are equidistantly spaced out in a transverse direction, permitting one growth-ring printing area 31 and two fine-texture printing areas 32 thereof alternatively arranged to precisely form at corresponding lengthwise and widthwise positions of the sequentially aligned printing rollers 30 thereon. The present invention includes printing steps as follows:

Three blind slats 40 are aligned side by side before the three printing rollers 30 already coated with coloring material thereon, and then transported forwards to go through the three printing rollers 30 in a sequence. Via the printing operation of the alternatively-arranged growth-ring printing areas 31 and the fine-texture printing areas 32 of the three printing rollers 30, the three blind slats 40 thereof will be synchronically printed with complete wood grain pattern at the surface thereon and finished with growth-ring pictures 41 and fine-texture pictures 42 distributed in the middle and both lateral sections thereon respectively as shown in FIG. 4. When the coloring material of the growth-ring pictures 41 and the fine-texture pictures 42 dries up, cord-passage holes 43 can be punched on the printed blind slat 40 to provide a horizontal-type blind slat as shown in FIG. 4 or a vertical-type blind slat 40 as shown in FIG. 5. Therefore, the printing method of the present invention can omit the tedious process of repeated withdrawal, relocation, and position-rotation of the above-mentioned conventional printing method for window blind slats thereof. As a result, the present invention can benefit a speedier and standardized production of the blind slats 40 to boost the competitive power thereof. Besides, the present invention can also avoid the problems of color-binding and grain-interrupting as found in the conventional printing method thereof to ensure an accurate control of the quality of each blind slat 40 and achieve a standardized manufacturing thereof.

What is claimed is:

1. A method for producing printed window blind slats, including the following steps:

providing three blind slats located side by side;

providing three printing rollers each having one growth-ring printing area and two fine texture printing areas on its respective surface, the growth-ring printing areas and the fine-texture printing areas of the printing rollers are in wood grain pattern coated with coloring material;

positioning said three printing rollers equidistantly and sequentially apart in a printing direction such that the growth-ring printing area and the two fine-texture printing areas on each printing roller are alternatively arranged at corresponding lengthwise and widthwise position of the sequentially aligned printing rollers;

transporting the three blind slats in the printing direction simultaneously through the three printing rollers in sequence; and printing the coated coloring material from the alternatively-arranged growth-ring printing areas and the fine-texture printing areas of the three printing rollers on the three blind slats such that each of the blind slats is printed with a complete wood grain pattern bearing growth-ring pictures and fine-texture pictures disposed thereon.

* * * * *